US009812828B1

(12) United States Patent
Hunter

(10) Patent No.: US 9,812,828 B1
(45) Date of Patent: Nov. 7, 2017

(54) WEDGE SHAPED POWER STATION AND RELATED METHODS

(71) Applicant: Scott Hunter, Orlando, FL (US)

(72) Inventor: Scott Hunter, Orlando, FL (US)

( * ) Notice: Subject to any disclaimer, the term of this patent is extended or adjusted under 35 U.S.C. 154(b) by 0 days.

(21) Appl. No.: 15/166,355

(22) Filed: May 27, 2016

(51) Int. Cl.
*H01R 13/66* (2006.01)
*H01R 25/00* (2006.01)

(52) U.S. Cl.
CPC ..... *H01R 25/003* (2013.01)

(58) Field of Classification Search
CPC ..... H01R 25/003
USPC ..... 439/40, 650, 652, 575, 574, 535
See application file for complete search history.

(56) References Cited

U.S. PATENT DOCUMENTS 3,297,886 A * 1/1967 Danner ..... H01R 25/006 200/294
3,843,082 A * 10/1974 Garrett ..... B63B 45/04 114/364
4,186,903 A 2/1980 Fazakerley
4,570,888 A 2/1986 Evans
5,181,682 A 1/1993 Indelicato
6,050,849 A * 4/2000 Chang ..... G06F 1/16 439/536
7,675,264 B2 * 3/2010 Lin ..... H02J 7/0027 320/115
8,174,147 B2 * 5/2012 Fleisig ..... H01R 13/72 174/493
8,415,920 B2 * 4/2013 Liao ..... H01R 31/065 16/225
8,482,424 B2 7/2013 Wright et al.
D693,305 S 11/2013 Kuo et al.
8,578,528 B1 11/2013 Heare
8,844,074 B2 9/2014 Mohr et al.
8,864,517 B2 * 10/2014 Cohen ..... H01R 13/73 439/536
D720,554 S 1/2015 Hardy
9,161,464 B2 * 10/2015 Liao ..... H05K 5/0065
2004/0261175 A1 12/2004 May
2006/0207212 A1 * 9/2006 Durney ..... E04B 2/78 52/846
2007/0081024 A1 * 4/2007 Morgan ..... B41J 2/16535 347/36
2007/0163969 A1 * 7/2007 Huszczo ..... B65G 49/062 211/45
2008/0157715 A1 * 7/2008 Rosenboom ..... H02J 7/0044 320/108
2008/0278113 A1 * 11/2008 Fan ..... H02J 7/0044 320/113
2010/0231161 A1 9/2010 Brown
2011/0132634 A1 * 6/2011 Fetzer-Westmeister . H02G 3/14 174/66

(Continued)

*Primary Examiner* — Abdullah Riyami
*Assistant Examiner* — Nelson R Burgos-Guntin
(74) *Attorney, Agent, or Firm* — Allen Dyer Doppelt & Gilchrist, PA.

(57) ABSTRACT

A power station includes a wedge-shaped body including first and second surfaces extending between respective first and second ends. The respective first ends meet with the respective second ends being spaced apart in a rest position. The first and second surfaces are biased apart from each other such that an outward force is generated thereby when urged together from the rest position. At least one power socket is located on the wedge-shaped body and configured for connection to an electrical power source.

20 Claims, 8 Drawing Sheets

(56) References Cited

U.S. PATENT DOCUMENTS

| | | | | |
|---|---|---|---|---|
| 2012/0098493 | A1 | 4/2012 | Budike | |
| 2014/0030910 | A1* | 1/2014 | Carpanzano | H01R 13/74 439/501 |
| 2014/0127948 | A1* | 5/2014 | Beldock | H01R 25/006 439/652 |
| 2016/0015168 | A1* | 1/2016 | Sun | F16M 13/00 248/447.1 |
| 2016/0204561 | A1* | 7/2016 | Stephens | H01R 24/78 439/653 |

* cited by examiner

WEDGE SHAPED POWER STATION AND RELATED METHODS

FIELD OF THE INVENTION

The present invention relates to supplying power to multiple devices, and more particularly, to power stations for personal electronic devices.

BACKGROUND OF THE INVENTION

When using most electrical devices, including rechargeable, battery powered devices, the need for an electrical outlet eventually becomes a concern. Frequently, there is not an electrical outlet in a location convenient to where a user wants to use the device, and the user must either move or supply some sort of extension cord. The problem is further complicated when using most personal electronic devices, which typically cannot be connected directly to mains voltage, but must powered and/or charged via some type of adapter. In the modern home, there may be multiple personal electronic devices needing to be powered and/or charged at the same time (and even in the same location), but an insufficient number of adapters are available or conveniently available to meet all users' needs. While some power stations have been developed to facilitate the simultaneous supply of electrical power to multiple electrical devices in one location, further improvements are possible.

SUMMARY OF THE INVENTION

In view of the foregoing, it is an object of the present invention to provide an improved power station. According to an embodiment of the present invention, a power station includes a wedge-shaped body including first and second surfaces extending between respective first and second ends. The respective first ends meet with the respective second ends being spaced apart in a rest position. The first and second surfaces are biased apart from each other such that an outward force is generated thereby when urged together from the rest position. At least one power socket is located on the wedge-shaped body and configured for connection to an electrical power source.

A method of charging an electronic device with power station includes selecting a location for the power station. The wedge-shaped body of the power station is positioned to the selected location such that the first surface and the second surface is urged together in the rest position. A charger of an electronic device is plugged to the at least one power socket of the power station, and the power station is connected to an external power source to charge the electronic device.

These and other objects, aspects and advantages of the present invention will be better understood in view of the drawing and following detailed description of preferred embodiments.

DETAILED DESCRIPTION OF PREFERRED EMBODIMENTS

Figure 1:
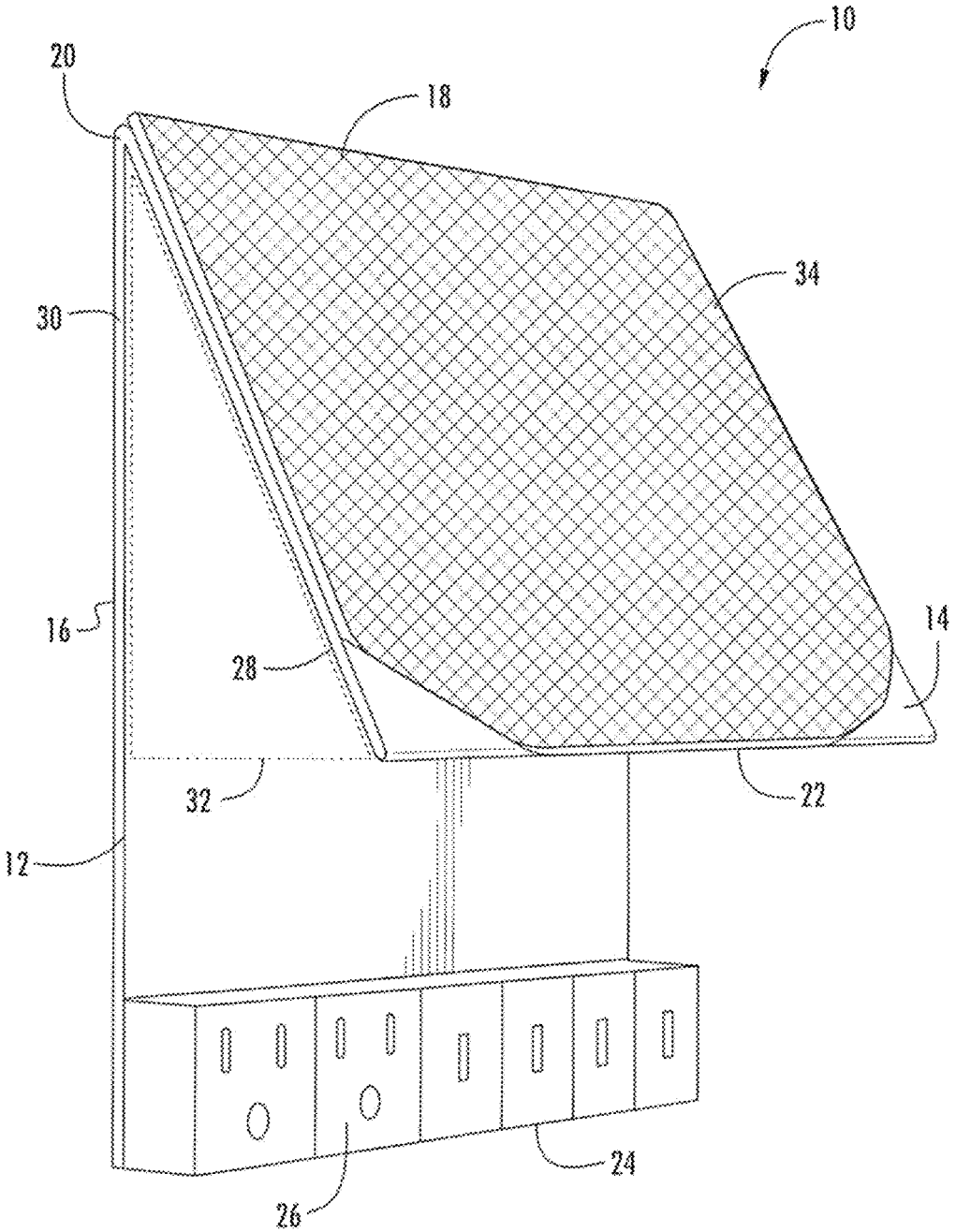
FIG. 1 is a perspective view of a power station, according to an embodiment of the present invention.
Figure 2:
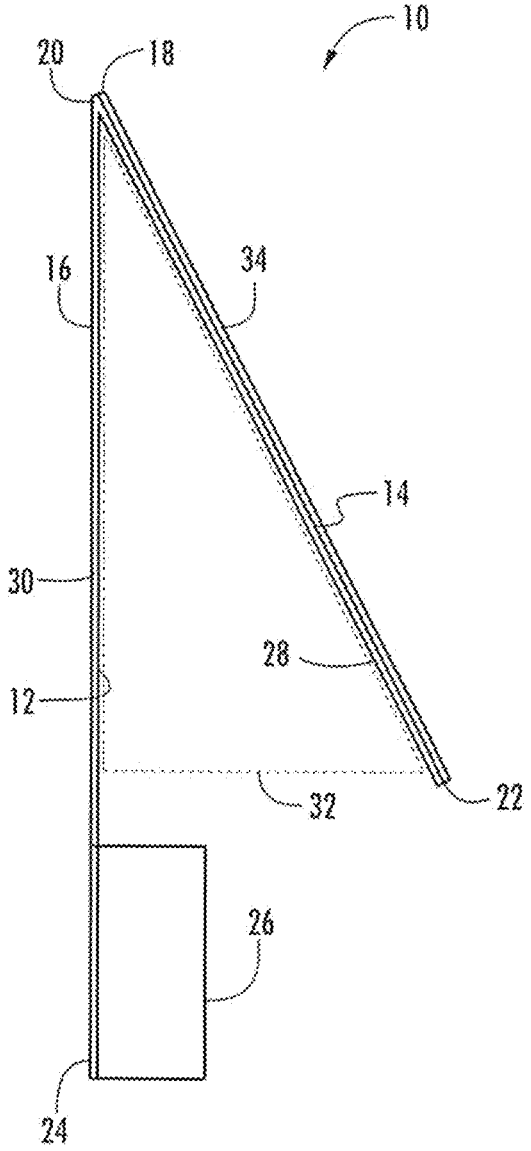
FIG. 2 is a side view of the power station of FIG. 1.

According to an embodiment of the present invention and referring to FIGS. 1 and 2, a power station 10 includes a wedge-shaped body 12 including first and second surfaces 14 and 16 extending between respective first ends 18, 20 and second ends 22 and 24. The respective first ends 18 and 20 meet and the respective second ends 22 and 24 are spaced apart in a rest position. The first and second surfaces 14 and 16 are biased apart from each other such that an outward force is generated thereby when urged together from the rest position. At least one power socket 26 is located on the wedge-shaped body 12 and configured to receive power from an electrical mains power source or other external power source.

The wedge-shaped body 12 can include first and second plates 28 and 30 with the first and second surfaces 14 and 16 forming respective outer faces thereof. The first and second plates 28 and 30 adjoining at the respective first ends 18 and 20 of the first and second surfaces 14 and 16. Advantageously, the plates 28, 30 are part of an integrally-formed, unitary structure, with the inherent resilience of the structure about the junction of the first ends 18, 20 providing the outward force. Alternately, a resilient biasing element 32 can be placed between the plates 28, 30 providing the outward force thereto.

A high-friction surface 34 can be integrally formed on (or attached to) the first surface 14 and/or the second surface 16 to increase holding power of the power station 10. For example, high friction surface 34 comprises hard particles embedded therein and portions of the particles protruding above the surface so as to provide greater frictional grip for the respective surface.

Figure 3:
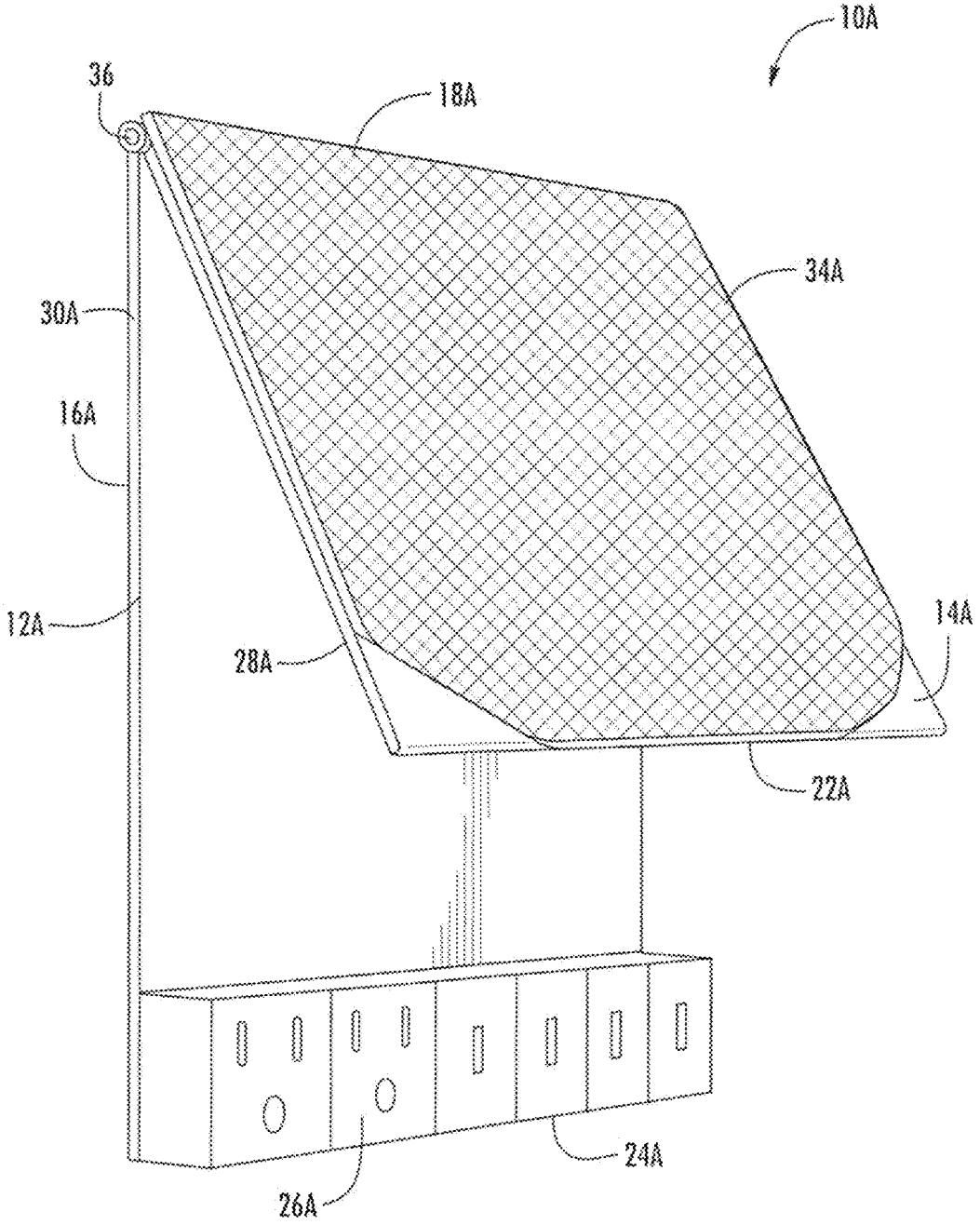
FIG. 3 is a perspective view of a power station, according to another embodiment of the present invention.
Figure 4:
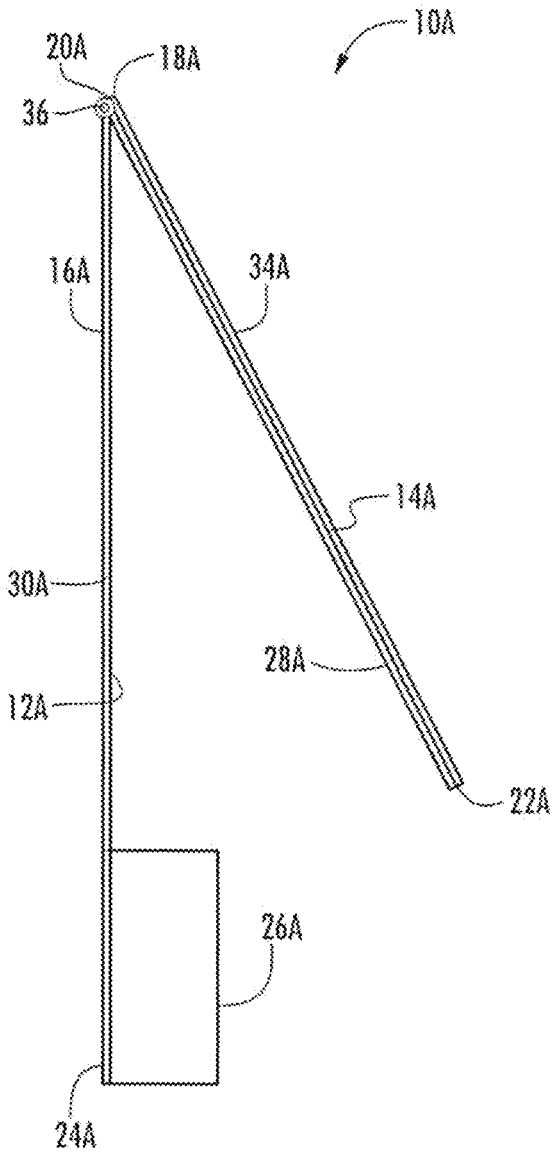
FIG. 4 is a side view of the power station of FIG. 3.
Figure 5:
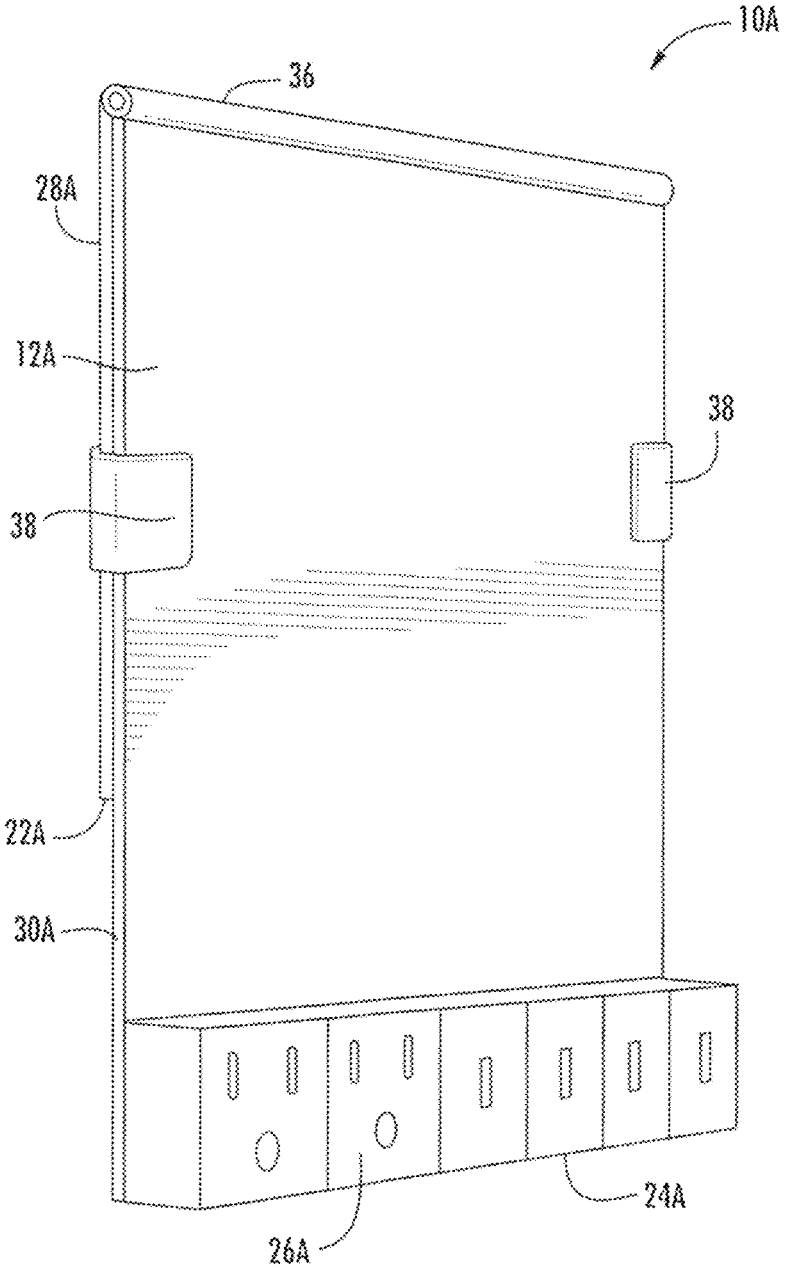
FIG. 5 is a perspective view of the power station of FIG. 3 in a folded position.

In another embodiment, referring to FIGS. 3-5, a power station 10A has a wedge-shaped body 12A including separate first and second plates 28A and 30A connected by a hinge 36. In the depiction of alternate embodiments, like elements are given like reference numbers, followed by a letter. Except as otherwise described, similarly numbered components have similar function and structure.

The hinge 36 can allow rotation into between the rest position (FIGS. 3 and 4) a storage position (see FIG. 5), where the first and second plates 28, 30 abut face-to-face. In the storage position, clips 38 or other fasteners can hold the plates 28, 30 closed. Thus, less space is required for storage and/or transport.

When rotated open in the opposite direction (FIGS. 3 and 4), the hinge 36 limits holds the plates 28A, 30A in the rest position. The outward force generated when trying to close the plates 28A, 30A past inwardly from the rest position can be provided by biasing (e.g., spring biasing) of the hinge 36 and/or the inherent resiliency of the first and second plates 28A and 30A adjacent thereto. Additionally, a biasing element like the biasing element 32 could be used between the plates 28A and 30A.

In the depicted embodiment, as shown in FIGS. 1-5, the first plate 28 (or 28A) and the second plate 30 (or 30A) are rectangular. The length of the first plate 28 (or 28A) is smaller than the length of the second plate 30 (or 30A), and the power socket 26 (or 26A) is located on the second plate 30 (or 30A). The power socket 26 (or 26A) can also be located at other portion of the wedge-shaped body 12 (or 12A). Various dimensions and shapes of wedge shaped body 12 (or 12A), the first plate 28 (or 28A) and the second plate 30 (or 30A) can be used as desired. The wedge-shaped body 12 (or 12A), the first plate 28 (or 28A) and the second plate 30 (or 30A) are preferably molded from a polymeric material such as rubber, plastic, silicone, or the like. Other suitable materials can be used. The wedge-shaped body 12 (or 12A), the first surface 14 (or 14A), and the second surface 16 (or 16A) can be of different colors, and can comprise different designs, patterns, and/or messages.

The power station 10 or 10A can further be connected to a transformer, a rectifier a smoothing and regulating electronic circuit, or some other circuit to provide a required charging voltage and/or current. The invention is not limited to a particular charging circuit or components.

Figure 6:
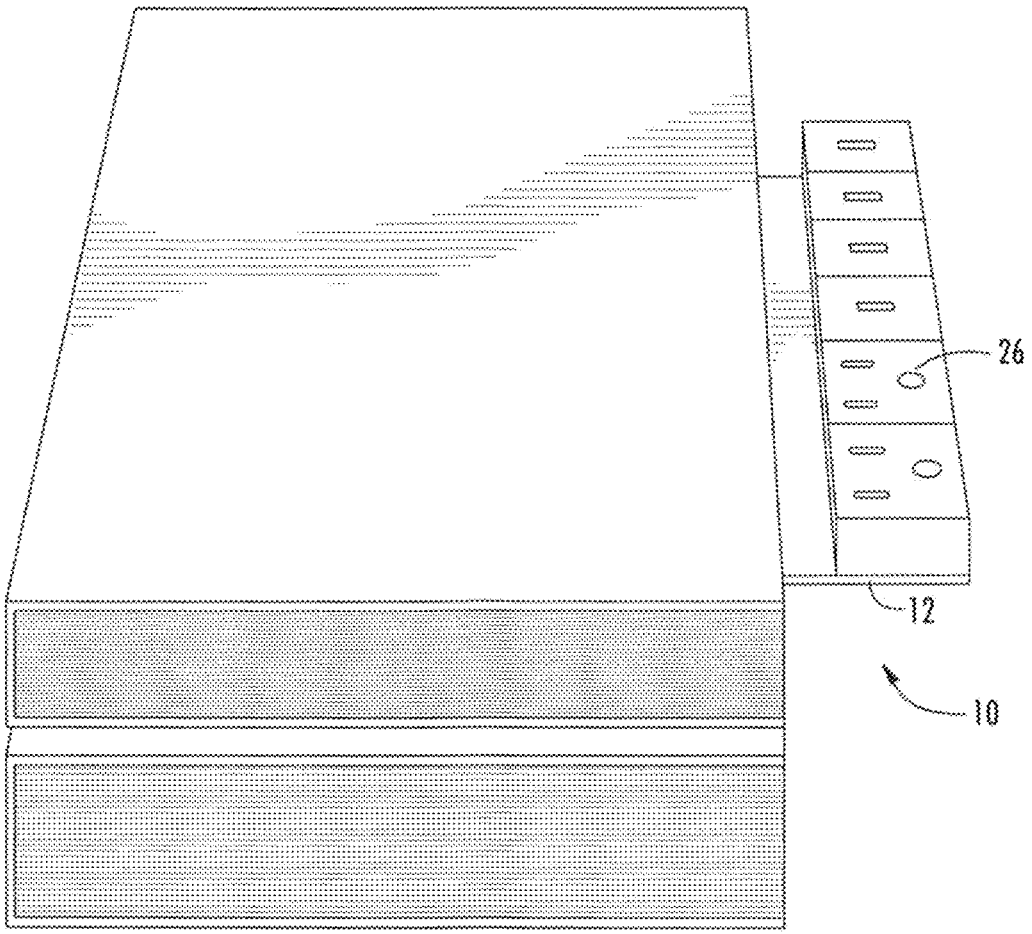
FIG. 6 illustrates an exemplary location of the power station of FIG. 1.
Figure 7:
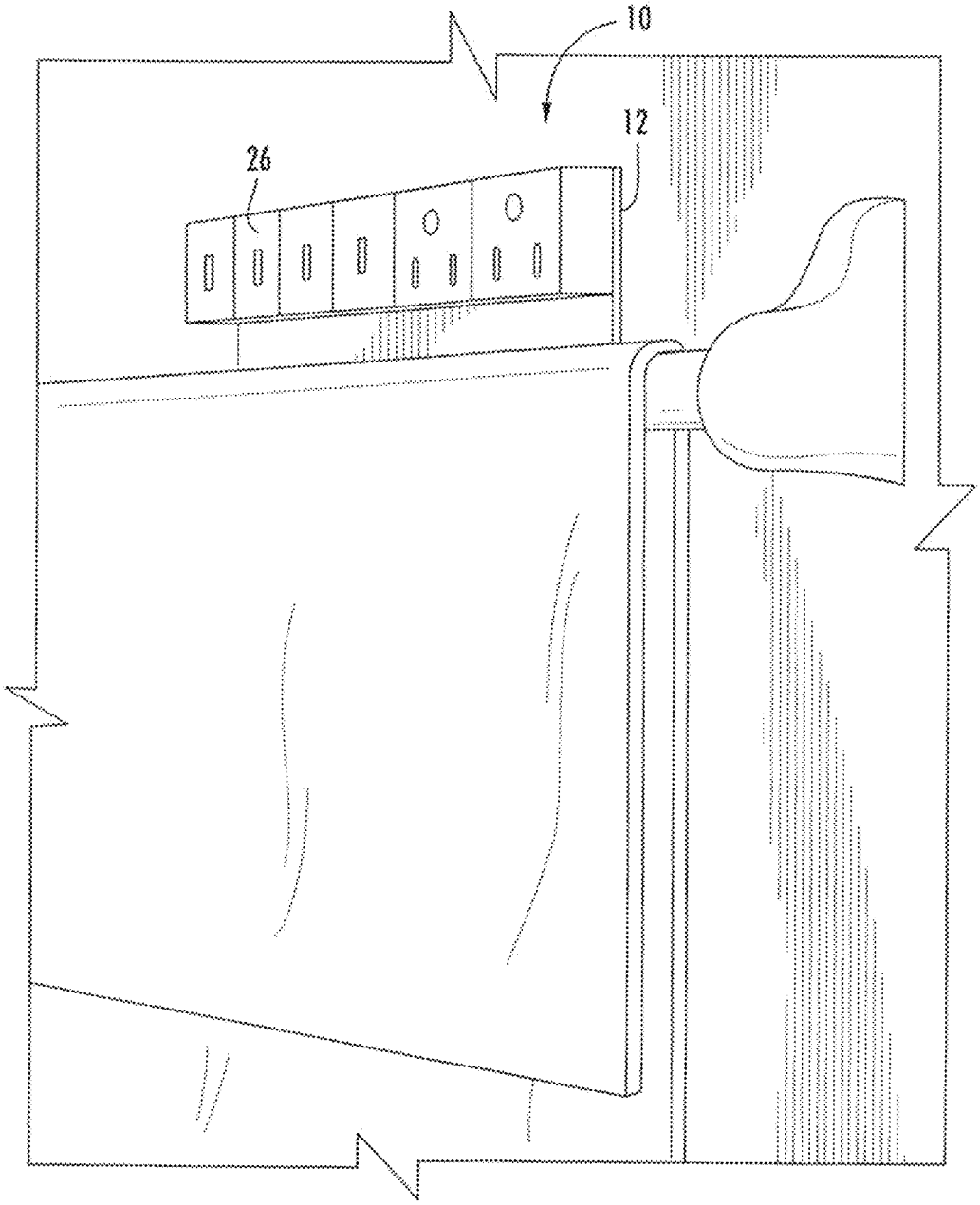
FIG. 7 illustrates another exemplary location of the power station of FIG. 1.
Figure 8:
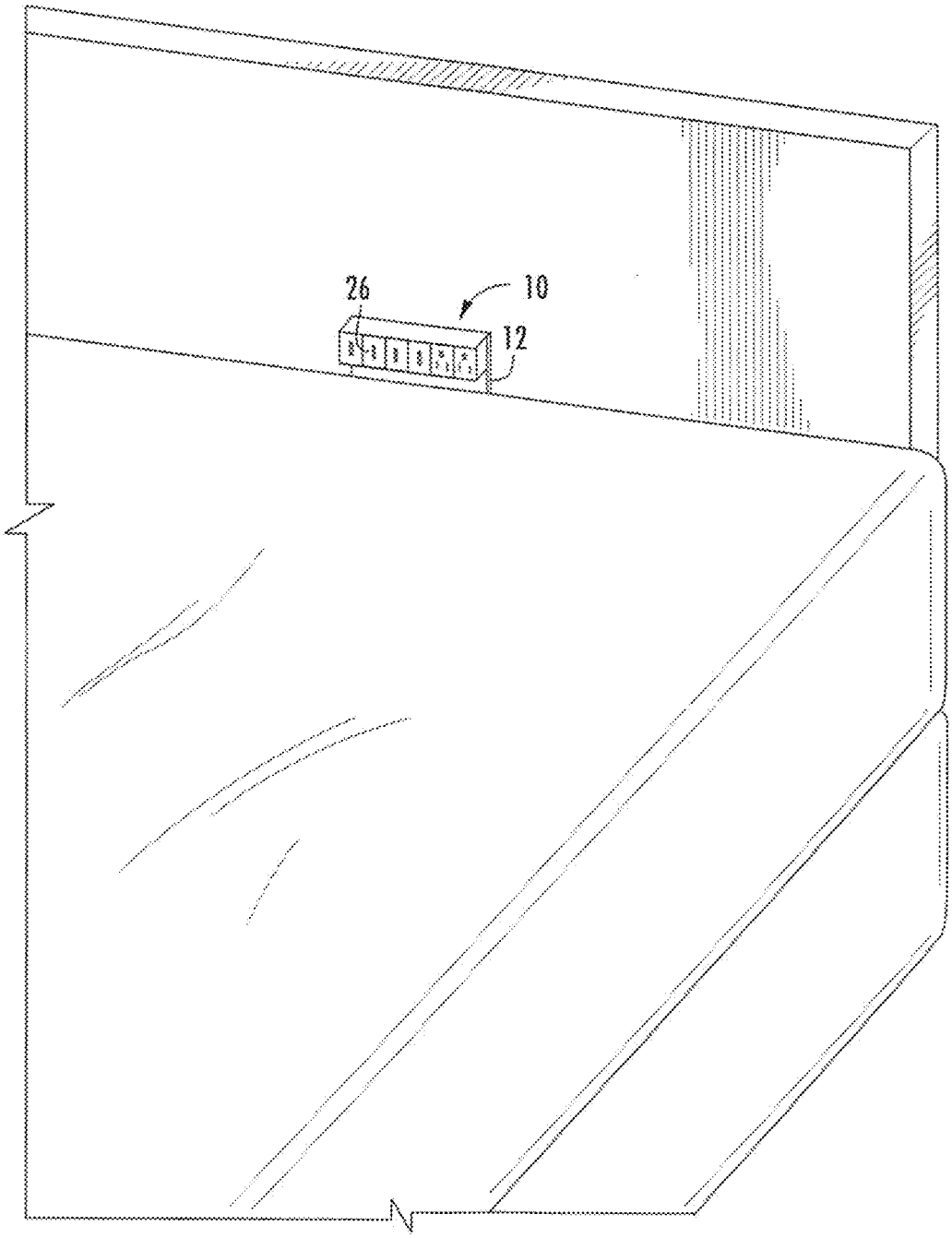
FIG. 8 illustrates yet another exemplary location of the power station of FIG. 1.

The wedge-shaped body 12 (or 12A) allows the power station 10 (or 10A) to be securely held in virtually any crack or a crevice. For example, the power station 10 (or 10A) can be stored between books or book pages (e.g., see FIG. 6), between a towel bar and a wall (e.g., see FIG. 7), between a mattress and a headboard, (e.g., see FIG. 8), between couch cushions, and any other confined areas able to receive at least a portion of the wedge-shaped body 12.

When charging an electronic device a location for the power station 10 (or 10A) is selected. The wedge-shaped body 12 (or 12A) is then positioned to the selected location such that the first surface and the second surface 14 (or 14A) and 16 (or 16A) are urged together in the rest position. A charger of the electronic device is plugged to the at least one power socket 26 (or 26A) of the power station. The power station 10 (or 10A) is connected to an external power source. As an example, the location of the power station 10 (or 10A) can be a confined area such as a crack or a crevice.

In general the foregoing description is provided for exemplary and illustrative purposes; the present invention is not necessarily limited thereto. Rather, those skilled in the art will appreciate that additional modifications, as well as adaptations for particular circumstances, will fall within the scope of the invention as herein shown and described and of the claims appended hereto.

What is claimed is:

1. A power station comprising:

a wedge-shaped body including first and second surfaces extending between respective first and second ends, the respective first ends meeting with the respective second ends being spaced apart in a rest position, the first and second surfaces being biased apart from each other such that an outward force is generated thereby when urged together from the rest position; and at least one power socket located on the wedge-shaped body and configured for connection to an electrical power source.

2. The power station of claim 1, wherein the wedge-shaped body includes first and second plates with the first and second surfaces forming respective outer faces thereof, the first and second plates adjoining at the respective first ends of the first and second surfaces.

3. The power station of claim 2, wherein the biasing of the first and second surfaces is generated by an inherent resiliency of the first and second plates when elastically deformed into closer engagement than in the rest position.

4. The power station of claim 3, wherein the first and the second plates are formed as a single unitary piece.

5. The power station of claim 2, wherein the wedge-shaped body includes a hinge between the first and second plates.

6. The power station of claim 5, wherein the hinge is acting as a separate biasing element.

7. The power station of claim 5, wherein the hinge is a spring loaded hinge.

8. The power station of claim 5, wherein at least one of the first plate and the second plate rotates around the hinge to a folded position.

9. The power station of claim 1, wherein a high friction surface is integrally formed at least one of the first surface and the second surface.

10. The power station of claim 1, wherein a high friction surface is attached to at least one of the first surface and the second surface.

11. The power station of claim 1, wherein the at least one power socket is a USB power socket.

12. The power station of claim 1, wherein the at least one power socket is a standard electrical socket.

13. A method for charging an electronic device using a power station, wherein the power station comprises a wedge-shaped body including first and second surfaces extending between respective first and second ends, the respective first ends meeting with the respective second ends being spaced apart in a rest position, the first and second surfaces being biased apart from each other such that an outward force is generated thereby when urged together from the rest position, and at least one power socket located on the wedge-shaped body and configured for connection to an electrical power source; the method comprising the steps of:

selecting a location for the power station;

positioning the wedge-shaped body to the selected location such that the first surface and the second surface is urged together in the rest position;

plugging a charger of the electronic device to the at least one power socket of the power station; and connecting the power station to an external power source.

14. A power station comprising;

a wedge-shaped body including first and second surfaces extending between respective first and second ends, the respective first ends meeting with the respective second ends being spaced apart in a rest position, the first and second surfaces being biased apart from each other such that an outward force is generated thereby when urged together from the rest position; and at least one power socket located on the wedge-shaped body and configured for connection to an electrical power source; and wherein the wedge-shaped body includes first and second plates with the first and second surfaces forming respective outer faces thereof, the first and second plates adjoining at the respective first ends of the first and second surfaces; and wherein the biasing of the first and second surfaces is generated by an inherent resiliency of the first and second plates when elastically deformed into closer engagement than in the rest position.

15. The power station of claim 14, wherein the wedge-shaped body includes a hinge between the first and second plates.

16. The power station of claim 14, wherein the hinge is a spring loaded hinge.

17. The power station of claim 14, wherein the at least one power socket is a USB power socket.

18. The power station of claim 14, wherein the at least one power socket is a standard electrical socket.

19. The power station of claim 14, wherein a high friction surface is integrally formed at least one of the first surface and the second surface.

20. The power station of claim 14, wherein a high friction surface is attached to at least one of the first surface and the second surface.

* * * * *